United States Patent [19]

Cvacho

[11] 4,211,050

[45] Jul. 8, 1980

[54] SEALING PROCESS FOR UNDERGROUND WALLS

[76] Inventor: Daniel S. Cvacho, 241 Kirkley Cir., Forest, Va. 24551

[21] Appl. No.: 954,290

[22] Filed: Oct. 24, 1978

[51] Int. Cl.[2] ..... E02D 31/02

[52] U.S. Cl. ..... 52/742; 52/169.14; 239/271

[58] Field of Search ..... 52/169.14, 169.5, 742, 52/515; 405/116, 117, 263–269; 239/271, 272, 276, 288.5

[56] References Cited

U.S. PATENT DOCUMENTS 3,676,198 7/1972 McGroarty .

FOREIGN PATENT DOCUMENTS 922908 3/1973 Canada ..... 405/269

*Primary Examiner*—John E. Murtagh

*Attorney, Agent, or Firm*—Richard P. Matthews

[57] ABSTRACT

A process for sealing underground walls so as to prevent water from seeping through the walls. A hollow pipe is inserted at a first position and a sealant material is injected through the pipe to effect a seal between a footing and the bottom of the wall. The hollow pipe is withdrawn vertically and progressively while injecting additional sealant material. Thereafter, the hollow pipe is indexed laterally and the wall sealed as before from the footing to grade level and this procedure is repeated until the entire underground wall is sealed externally.

In a modified form of the invention, the hollow tube is withdrawn and then the sealant is applied through the opening created by the insertion and withdrawal of the hollow tube.

14 Claims, 7 Drawing Figures

SEALING PROCESS FOR UNDERGROUND WALLS

BACKGROUND OF THE INVENTION

This invention relates to a sealing process for underground walls and, more particularly, to such a sealing process which insures a long lasting sealing of underground walls.

Heretofore, a number of different approaches have been tried to obtain satisfactory wall sealing systems. Among these approaches is included the procedure for digging up the entire lawn including all shrubs, and re-seal the wall from a standing position in front of it. However, not only is this expensive but as temperature variations cause the walls to expand and contract the seal breaks and cracks, and the wall leaks again in a short time.

Another procedure is to break up the floor inside and to form a cement trench all around and draw this to a sump pump. This procedure is not only expensive but also unsightly.

Another procedure is to pump gilsonite (volcanic ash) into the ground around the building. Gilsonite is a volcanic material mixed with water which expands when wet. This is mixed with water and pumped into the ground. This procedure is still relatively expensive and while it works occasionally, it is not sufficiently reliable to warrant a guarantee and is thus unsatisfactory.

Still another procedure is to paint the wall on the inside with a waterproof paint. This does not prevent the wall from cracking again and in addition water often seeks other openings and seeps through the wall.

SUMMARY OF THE INVENTION

In accordance with the present invention, a sealant which contains tar or latex type waterproofing is blended with sufficient thinner and plasticizer to keep the tar or latex flexible. Since the liquid is underground with the soil staying wet, the waterproof liquid remains pliable. A process for injecting the sealant has been devised which does not destroy or injure shrubs or other landscaping features.

In one form of the invention, compressed air is utilized to facilitate easy insertion of a hollow tube into the ground directly adjacent the underground wall to be protected. The entire wall and the first inch or two of soil at the wall can be saturated and waterproofed. The use of compressed air keeps holes that are provided in the hollow tube from becoming clogged as the tube is inserted. The liquid sealant is applied under a pressure of from 20 to 150 pounds per square inch approximately, and the compressed air pressure may vary from about 20 to approximately 100 pounds per square inch. The walls are pressure treated from the outside at high pressure so that all cracks and holes are filled.

In a preferred form of the invention, a hollow pipe is inserted substantially vertically at a first position closely adjacent a wall until it contacts a wall footing at the base of the wall. A sealant material is then injected through the hollow pipe to effect a seal between the footing and the bottom of the wall. The pipe is then withdrawn progressively in a substantially vertical plane while injecting additional sealant material until the wall is sealed from the footing to grade level in a first vertical position. The hollow pipe is then indexed laterally and the steps of insertion of the pipe, injection of the sealant and withdrawal of the pipe while injecting additional sealant is repeated until the entire underground wall is sealed externally from the footing to the grade level.

Preferably, the hollow pipe used to insert the sealant is of a length approximately three feet longer than the depth of the wall beneath the surface of the ground or grade level. This construction facilitates the use of a valving arrangement whereby a pipe may be used to convey alternately compressed air for the insertion of the pipe within the ground and then the injecting of the sealant material to and through the lower end of the pipe which preferably is provided with a plurality of holes at its lower extremity adjacent the wall being sealed. The pipe is preferably provided with a chrome plating and polished or made from a pipe which is galvanized on the outside.

A slight trench is dug at grade level to prevent any unsightly discoloration of the wall at the ground line by the tar or other sealant material. The end of the pipe is also preferably flattened so that the pipe hugs the underground wall during the insertion into the ground.

In a modified form of the present invention, after the hollow pipe has been inserted to the depth of the footing, the hollow pipe is withdrawn in a vertical direction, thereby leaving a narrow gap between the wall and the adjacent earth. A sealant material is then injected into the gap under pressure so as to fill the gap from the footing to the grade level. Thereafter, the hollow pipe is indexed laterally and the pipe is again inserted and withdrawn and additional sealant material is injected after the pipe has been withdrawn again filling the gap and this series of steps is repeated until the entire underground wall is sealed externally from the footing to the grade level.

The inherent advantages and improvements of the present invention will become more readily apparent upon reference to the detailed description of the invention and by reference to the accompanying drawings.

DETAILED DESCRIPTION OF A PREFERRED EMBODIMENT

Figure 1:
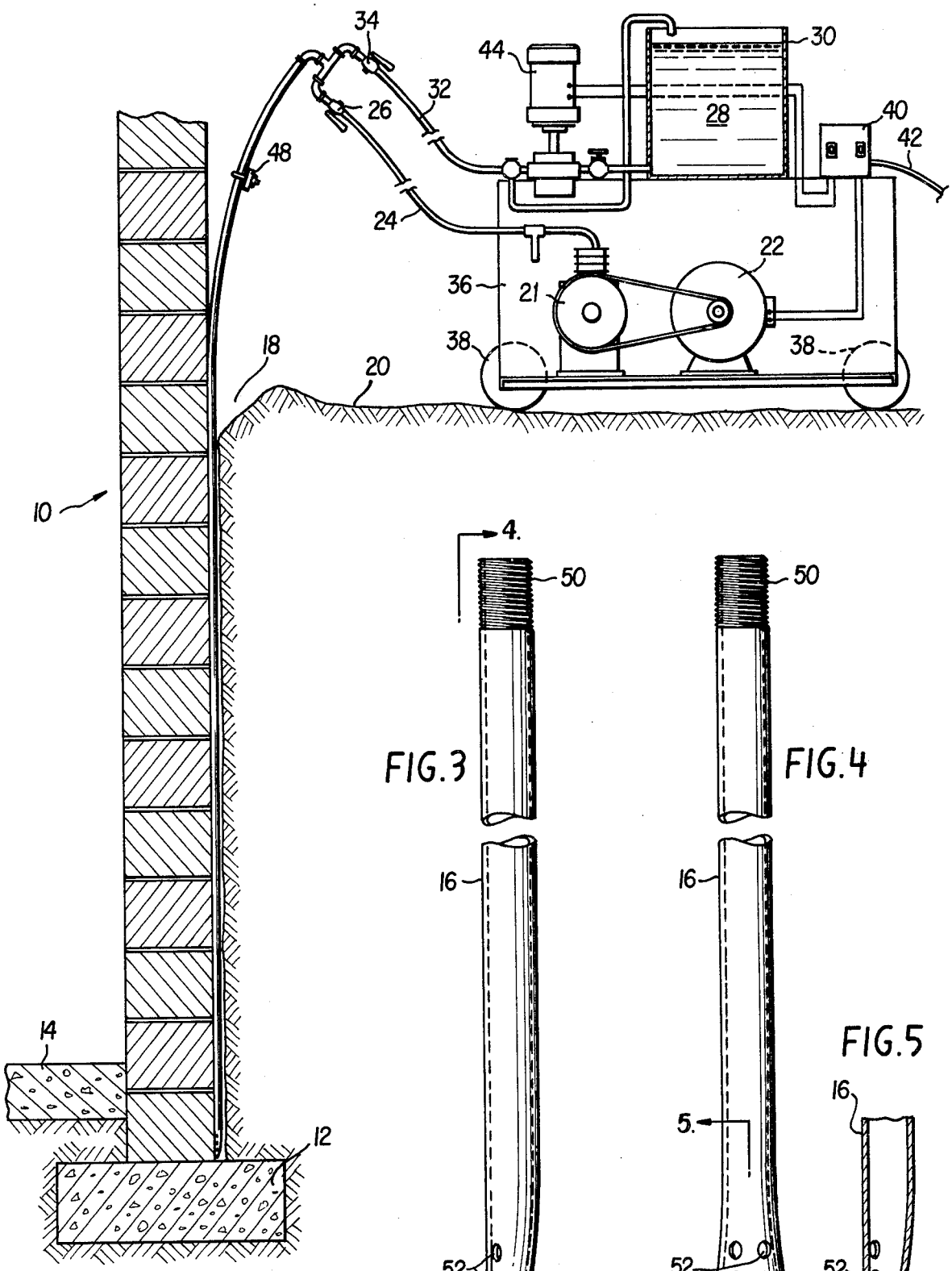
FIG. 1 is a fragmentary, side elevational view taken partially in vertical cross section showing apparatus for introducing a sealant supply tube in accordance with the present invention.

Referring now to FIG. 1 of the drawings, a masonry or concrete wall is indicated generally at 10 having a footing 12 in place beneath the surface of the ground. A concrete basement floor is illustrated at 14. A hollow pipe 16 is shown inserted between a gap between the masonry or concrete wall 10 and the adjacent ground. A small trench is shown at 18 between the ground or grade level 20 and the wall 10. In order to facilitate insertion of the hollow pipe 16 into the earth, compressed air from an air compressor 21 which is driven by an air compressor drive motor 22 supplies compressed air under a pressure of from 20 to 100 lbs. per square inch approximately through a flexible air line 24 which is controlled by an air shutoff valve 26. In a parallel line leading thereto, a sealant material 28 contained within a container for liquid 30 supplies a liquid sealant through a flexible liquid tubing 32 controlled by a liquid shutoff valve 34. Preferably, a cart 36 mounted on wheels 38 is used to transport both the air compressor and the container for liquid sealant and the means for supplying it to the hollow pipe 16. Thus, a main switch 40 having a power line 42 leading to a power source supplying either 100 volts or 220 volts is connected to the pump motor 44. A pump gear 46 controls the output to the flexible liquid tubing 32. A movable insertion handle is shown at 48 for guiding the hollow pipe 16 into the earth. Preferably, the length of the hollow pipe 16 is approximately three feet greater than the maximum depth to which the liquid sealant is to be supplied into the earth.

Figure 3:
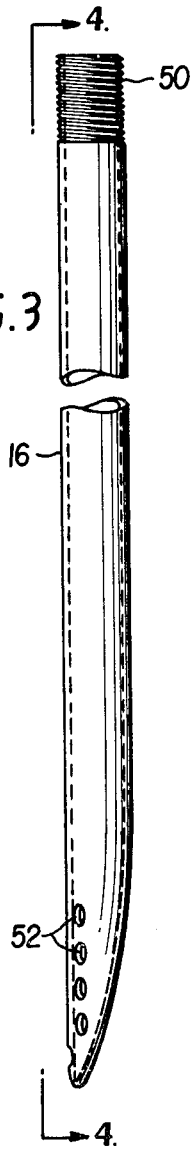
FIG. 3 is a side elevational view of the sealant supply tube of FIG. 1 drawn to an enlarged scale.
Figure 4:
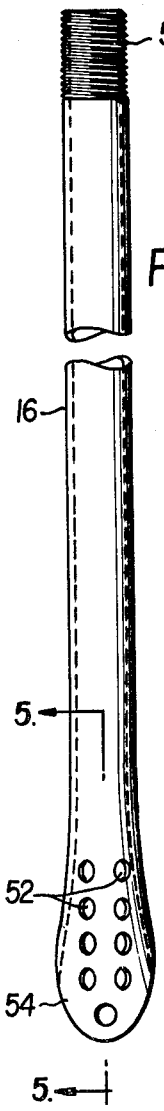
FIG. 4 is a front elevational view of the sealant supply tube of FIG. 3.
Figure 5:
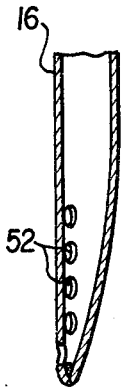
FIG. 5 is a fragmentary end elevational view taken in vertical cross section along line 5—5 of FIG. 4.

The details of construction of the hollow pipe 16 are shown more particularly in FIGS. 3–5. In these figures, the upper end of the pipe is shown to be threaded at 50 and the lower end is shown to be provided with a plurality of holes or apertures 52 to facilitate dispensing of the liquid sealant from the bottom of pipe 16. Also, the pipe 16 is preferably provided with a flattened end 54 and welded closed so that the pipe hugs the underground wall 10 during insertion into the ground.

Figure 2:
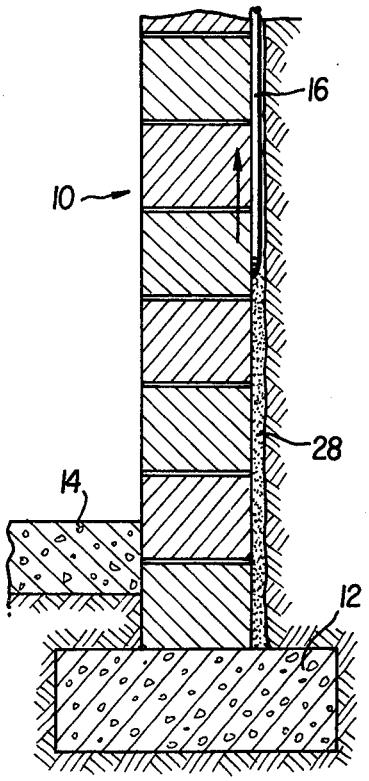
FIG. 2 is a fragmentary, vertical elevational view similar to FIG. 1 but showing the sealant supply tube in a position subsequent to that shown in FIG. 1.
Figure 6:
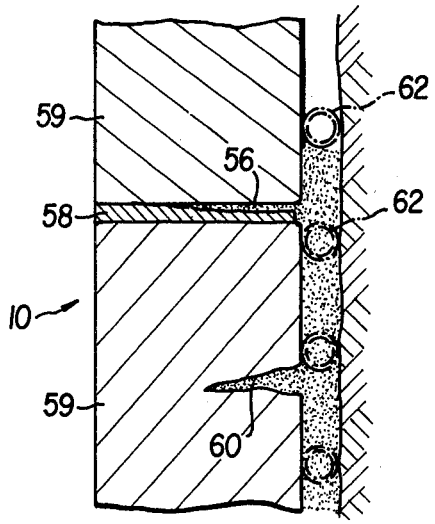
FIG. 6 is an enlarged top plan view taken in horizontal cross section along line 6—6 of FIG. 2.

FIGS. 2 and 6 illustrate a number of the sequential steps in the preferred method of the present invention. In particular, after the pipe 16 has been inserted into the position shown in FIG. 1 and a seal between the sealant 28 and the footing 12 in the base of wall 10 has been effected, the pipe 16 is progressively withdrawn as illustrated in FIG. 2 in a substantially vertical plane so that liquid sealant is deposited. The compressed air remains on until the tube has been inserted all the way to the footing which it contacts. Thereafter, the compressed air is shut off by valve 26 and valve 34 is opened permitting the pump motor 44 and pump gear 46 to supply liquid sealant through flexible liquid tubing 32 to the hollow pipe 16. After the seal has been effected between the base of the wall 10 and footing 12, the tube 16 is progressively withdrawn as is illustrated in FIG. 6 while additional sealant material 28 is injected under pressure until the wall is sealed from the footing 12 to the grade level 20.

Reference to FIG. 6 shows a crack or crevice 56 in the mortar 58 between adjacent individual blocks 59. Crevice 56 has been filled by the sealant material 28. In addition, a crack 60 in one of the masonry blocks 59 is also shown to have been filled by the sealant 28.

After the sealant has been deposited from the footing 12 to the grade level 20 the hollow pipe is indexed laterally such as is shown in FIG. 6 between two adjacent positions 62 of the hollow pipe. A lateral indexing of from four to six inches will usually be satisfactory to permit complete sealing of the exterior surface of the wall 10. After the indexing or lateral spacing has been effected, the steps of inserting the hollow pipe with the aid of compressed air, the ejecting of sealant material through the hollow pipe to effect a seal between the footing and the bottom of the wall and the progressive withdrawal of the pipe in a vertical plane while injecting additional sealant material is repeated for the next adjacent lateral position. In this manner, the entire underground wall is sealed externally under pressure from the footing to the grade level.

Figure 7:
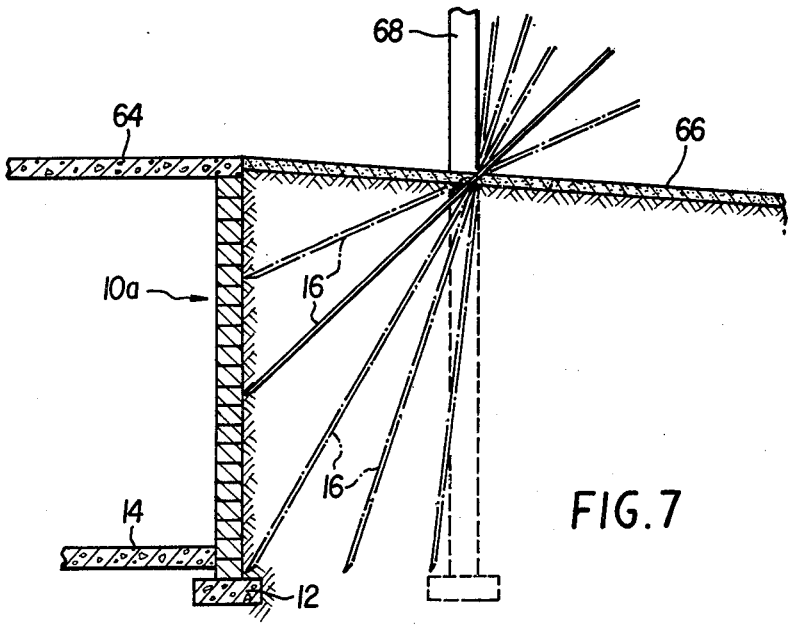
FIG. 7 is a side elevational view taken in vertical cross section illustrating various entrance angles for the sealant supply tube.

Referring now to FIG. 7, there is illustrated a wall **10*a* which extends beneath a carport 64 and a driveway 66 with the wall 10*a* being spaced inboard of the outer edge of the house exterior 68. The hollow pipe 16 is inserted at various angles with the aid of compressed air from the side of the driveway 66 so as to reach the external face of the wall 10*a***.

In accordance with the preferred mode of operation of the present invention, the hollow pipe 16 is inserted substantially vertically with the aid of compressed air at a first position closely adjacent the wall to a depth sufficiently deep so that a seal can be effected between the wall footing and the base of the wall with the aid of the injection of a sealant material through the hollow pipe. A valving arrangement permits the compressed air to be turned off before the sealant material is injected under pressure through the hollow pipe. The pipe is then withdrawn progressively in a substantially vertical plane while injecting additional sealant material through the hollow pipe until the wall is sealed from the footing to the grade level in the first vertical position. Thereafter, the hollow pipe is indexed laterally and the steps of inserting the hollow pipe with the aid of compressed air, injecting a sealant material through the hollow pipe to effect the seal between the footing and the bottom of the wall and the progressive withdrawal of the pipe while injecting additional sealant material is continued until the entire underground wall is sealed externally from the footing 12 to the grade level 20.

An alternative mode of operation is to insert the hollow pipe in a substantially vertical plane at a first position to a depth of the wall footing in the base of the wall with the air of compressed air pumped through the hollow pipe, withdrawing the hollow pipe substantially vertically thereby leaving a narrow gap between the wall and the adjacent earth and then injecting a sealant material to fill the gap substantially from the footing to the grade level. Thereafter, the hollow pipe is indexed laterally and the previously described steps are repeated, namely those of inserting the hollow pipe into the ground to the depth of the footing, withdrawing the hollow pipe in a vertical plane to leave a narrow gap between the wall and the adjacent earth, and then injecting a sealant material to fill the gap substantially from the footing 12 to the grade level 20. The lateral indexing is continued and the steps of inserting the pipe followed by withdrawal of the pipe and then injecting the sealant into the gap provided thereby is continued until the entire underground wall is sealed externally under pressure from the footing to the grade level.

In accordance with the present invention it is possible to effect sealing of the wall without destruction of any substantial amounts of shrubs or other landscaping adjacent the wall. The compressed air allows the tube to be inserted very easily and it also functions to prevent clogging of the apertures at the bottom of the tube as the tube is inserted. The entire wall and the first inch or two of the soil at the wall can be saturated and waterproofed. To facilitate easy insertion of the hollow pipe, the latter may be chrome plated and polished or the outside surface of the pipe may be galvanized. The pressure of the liquid creeps along the exterior wall and also soaks the adjacent wall. The soil being damp keeps the liquid waterproof material pliable. The waterproofing liquid may be a tar and thinner. In the step of withdrawing the tube from the footing after a seal has been made between the footing and the adjacent wall, the tube may be withdrawn in increments if desired, such as six inches or so and the pumping continued. This is repeated until the tube is fully drawn, at which point the liquid is shut off. In the indexing step the tube is moved laterally from about four to six inches and the process repeated until all desired exterior basement walls are sealed. Any suitable tar or latex type waterproofing material may be used blended with sufficient thinner and plasticizer to keep the tar and latex flexible. Because the liquid is underground with the soil staying wet the waterproof liquid remains pliable.

While a presently preferred embodiment of the invention has been illustrated as described, it will be recognized that the invention may be otherwise variously embodied and practiced within the scope of the claims which follow.

What is claimed is:

1. A process for sealing an underground wall from a footing beneath the ground to a grade level which comprises the steps of (a) inserting a hollow pipe substantially vertically at a first position closely adjacent said wall to a depth adjacent said wall footing and the base of the wall with the aid of compressed air pumped through said hollow pipe, (b) injecting a sealant material under a pressure of from about 20 to about 150 pounds per square inch through said hollow pipe to effect a seal between said footing and the bottom of said wall, (c) withdrawing said pipe vertically and progressively while injecting additional sealant material under said pressure until said wall is sealed from said footing to grade level in a first vertical position, 1. said compressed air serving to expose the surface of the wall which is then contacted by said sealant material under pressure whereby said wall is pressure treated from the outside at high pressure so that holes and cracks that may exist in the walls are filled, (d) indexing said hollow pipe laterally and repeating steps (a), (b), and (c), (e) and continuing said lateral indexing and the repetition of steps (a), (b), and (c) until said entire underground wall is sealed externally from said footing to grade level.

2. A process for sealing an underground wall as defined in claim 1 including the additional step of digging a slight trench at grade level to prevent any unsightly discoloration of the wall at the ground line.

3. A process for sealing an underground wall as defined in claim 1 including the additional step of making said hollow pipe of a sufficient length to exceed the depth of said wall beneath ground level.

4. A process for sealing an underground wall as defined in claim 1 including the additional step of forming a plurality of holes at the end of said hollow pipe which is inserted beneath the ground.

5. A process for sealing an underground wall as defined in claim 4 including the additional step of flattening the end of said hollow pipe that is inserted beneath the ground so that said pipe hugs said underground wall during insertion into the ground.

6. A process for sealing an underground wall as defined in claim 1 including the additional step of chrome plating said hollow pipe.

7. A process for sealing an underground wall as defined in claim 1 including the additional step of galvanizing the outside surface of said hollow pipe.

8. A process for sealing an underground wall from a footing beneath the ground to a grade level which comprises the steps of (a) inserting a hollow pipe substantially vertically at a first position to a depth of said wall footing and the base of the wall with the aid of compressed air pumped through said hollow pipe, (b) withdrawing said hollow pipe substantially vertically thereby leaving a narrow gap between said wall and the adjacent earth, (c) injecting a sealant material to fill said gap under a pressure of from about 20 to about 150 pounds per square inch substantially from said footing to said grade level, 1. said compressed air serving to expose the surface of the wall which is then contacted by said sealant material under pressure whereby said wall is pressure treated from the outside at high pressure so that all holes and cracks that may exist in the wall are filled, (d) indexing said hollow pipe laterally and repeating steps (a), (b), and (c), (e) and continuing said lateral indexing and the repetition of steps (a), (b), and (c) until said entire underground wall is sealed externally from said footing to said grade level.

9. A process for sealing an underground wall as defined in claim 8 including the additional step of digging a slight trench at grade level to prevent any unsightly discoloration of the wall at the ground line.

10. A process for sealing an underground wall as defined in claim 9 including the additional step of making said hollow pipe of a sufficient length to exceed the depth of said wall beneath ground level.

11. A process for sealing an underground wall as defined in claim 9 including the additional step of forming a plurality of holes at the end of said hollow pipe which is inserted beneath the ground.

12. A process for sealing an underground wall as defined in claim 11 including the additional step of flattening the end of said hollow pipe that is inserted beneath the ground so that said pipe hugs said underground wall during insertion into the ground.

13. A process for sealing an underground wall as defined in claim 9 including the additional step of chrome plating said hollow pipe.

14. A process for sealing an underground wall as defined in claim 9 including the additional step of galvanizing the outside surface of said hollow pipe.

* * * * *